US007519312B2

(12) United States Patent
Izumi et al.

(10) Patent No.: US 7,519,312 B2
(45) Date of Patent: Apr. 14, 2009

(54) DEVELOPING UNIT AND IMAGE FORMING DEVICE

(75) Inventors: Koji Izumi, Osaka (JP); Masami Ikeda, Osaka (JP); Satoshi Hayano, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 319 days.

(21) Appl. No.: 11/468,287

(22) Filed: Aug. 29, 2006

(65) Prior Publication Data

US 2007/0048009 A1 Mar. 1, 2007

(30) Foreign Application Priority Data

Aug. 31, 2005 (JP) ..... 2005-252494
Aug. 11, 2006 (JP) ..... 2006-219281

(51) Int. Cl.
*G03G 15/08* (2006.01)

(52) U.S. Cl. ..... 399/119

(58) Field of Classification Search ..... 399/119, 399/113, 126, 110, 265, 279
See application file for complete search history.

(56) References Cited

U.S. PATENT DOCUMENTS

| | | | | |
|---|---|---|---|---|
| 5,223,893 | A * | 6/1993 | Ikemoto et al. | 399/119 |
| 5,298,948 | A * | 3/1994 | Kurisu | 399/119 |
| 6,118,962 | A * | 9/2000 | Casper et al. | 399/119 |
| 6,647,233 | B2 * | 11/2003 | Hiroki | 399/110 |
| 6,944,415 | B2 * | 9/2005 | Nomura | 399/113 |
| 7,020,416 | B2 * | 3/2006 | Kato et al. | 399/110 |
| 7,035,569 | B2 * | 4/2006 | Park | 399/119 |
| 2002/0009305 | A1 * | 1/2002 | Uehara | |
| 2004/0052557 | A1 * | 3/2004 | Fukuta et al. | |
| 2005/0047825 | A1 | 3/2005 | Nakano et al. | |
| 2005/0133988 | A1 * | 6/2005 | Jacobs et al. | |
| 2005/0281583 | A1 * | 12/2005 | Yamada | 399/119 |
| 2006/0083544 | A1 * | 4/2006 | Okabe | |

FOREIGN PATENT DOCUMENTS

| | | | |
|---|---|---|---|
| CN | 1591227 | A | 3/2005 |
| JP | U-S62-132560 | | 8/1987 |
| JP | 2003-167424 | A | 6/2003 |
| JP | 2004-264519 | A | 9/2004 |
| JP | 2004-318092 | A | 11/2004 |

* cited by examiner

*Primary Examiner*—Susan S Lee
(74) *Attorney, Agent, or Firm*—Shinjyu Global IP

(57) ABSTRACT

A developing unit is disclosed which is configured to supply toner to a photosensitive drum in the body of an image forming device, and can be detachably mounted to the body of the image forming device. The developing includes a first developing roller and a roller contacting/retracting mechanism. The first developing roller can be arranged in a position proximate to and parallel with the photosensitive drum, or a position retracted from the photosensitive drum. The roller contacting/retracting mechanism is configured to move the first developing roller to the position proximate to the photosensitive drum when the developing unit is attached to the body of the image forming device, and move the first developing roller to the position retracted from the photosensitive drum when detaching the developing unit from the body of the image forming device.

14 Claims, 14 Drawing Sheets

DEVELOPING UNIT AND IMAGE FORMING DEVICE

This application claims priority to Japanese Patent Application Nos. 2005-252494 and 2006-219281. The entire disclosure of Japanese Patent Application Nos. 2005-252494 and 2006-219281 is hereby incorporated herein by reference.

BACKGROUND OF THE INVENTION

Field of the Invention

The present invention relates to a developing unit, and in particular, a developing unit that provides a photosensitive drum in an image forming device with toner and is detachably mounted to an image forming device. In addition, the present invention relates to an image forming device including the same.

An electrophotographic image forming device such as a laser printer comprises a photosensitive drum on which a toner image is formed and a developing unit for providing the photosensitive drum with toner. The developing unit comprises a developing roller that is arranged to be in proximity to and in parallel with the photosensitive drum.

A conventional developing unit has been known which can be detachably mounted in an image forming device. However, as described above, the developing roller is arranged to be in proximity to the photosensitive drum. Therefore, there is a possibility that the developing roller will strike the photosensitive drum when the developing unit is attached to or detached from the image forming device. In order to solve this problem, the following type of conventional developing unit has been suggested. The developing unit is pushed from the front side to the back side in the axial direction of the rotation axis of the photosensitive drum so that it is mounted to a predetermined position located away from the photosensitive drum in the interior of an image forming device, and then horizontally moved to be in proximity to the photosensitive drum.

Related technologies have been disclosed, such as for example in Japan Patent Application Publications JP-A-2003-167424 and JP-A-2004-264519.

However, the following two operations must be separately performed in the above described conventional developing unit: (i) arranging the developing unit in the interior of the image forming device and (ii) moving the developing roller to be in proximity to the photosensitive drum. Accordingly, the device has inferior operability and erroneous operations could be performed therein.

It is therefore an object of the present invention to provide a developing unit whose developing roller can be automatically moved to be in a proximal position to or a retracted position from a photosensitive drum when the developing unit is attached to or detached from an image forming device.

SUMMARY OF THE INVENTION

According to a first aspect of the present invention, a developing unit configured to supply toner to a photosensitive drum in an image forming device is detachably mounted to the body of the image forming device. The developing unit comprises a first developing roller and a roller contacting/retracting mechanism. The first developing roller can be arranged in a proximal position to and parallel to the photosensitive drum in the interior of the body of the image forming device, and arranged in a position retracted from the photosensitive drum. The roller contacting/retracting mechanism is configured to move the first developing roller to a proximal position to the photosensitive drum in association with an operation that attaches the developing unit to the image forming device body, and move the first developing roller to a retracted position from the photosensitive drum in association with an operation that detaches the developing unit from the image forming device body.

With this developing unit, the developing roller is automatically moved to a proximal position to or a retracted position from the photosensitive drum body in association with the operation that attaches/detaches the developing unit to/from the image forming device body. Therefore, it is possible to perform an operation of attaching/detaching the developing unit to/from the image forming device body and an operation of arranging the developing unit in proximal position to or a retracted position from the photosensitive drum at once. Thus, operability of the developing unit can be improved and erroneous operation thereof can be inhibited.

Note that the number of the developing rollers may be one, or may be two, as in a second aspect of the present invention that is described below.

In addition, the axial direction includes a direction in which the rotational axis of the photosensitive drum extends and a direction substantially parallel to this direction.

An attachment operation includes not only an operation for pushing the developing unit into a mounting portion that is described later of the image forming device body toward the rear side in the axial direction, but also other operations. For example, if the image forming device body comprises an opening/closing unit that is described later, the attachment operation includes an operation for closing the opening/closing unit after the developing device is pushed into the mounting portion toward the rear side in the axial direction.

In addition, the expression "in association with an attachment operation" includes not only a situation in which the entire attachment operation is performed but a situation in which a portion of the attachment operation is performed. Therefore, for example, if the image forming device body includes an opening/closing unit, the first developing roller may be moved to a proximal position to the photosensitive drum when the developing unit is mounted to the mounting portion before the opening/closing unit is closed. In addition, the first developing roller may not be moved to a proximal position to the photosensitive drum when the developing unit is mounted to the mounting portion, but may be moved to a proximal position to the photosensitive drum when the opening/closing unit is closed after the developing unit is mounted to the mounting portion.

On the other hand, the detachment operation includes not only the operation of pulling the developing unit out of a mounting portion that is described later of the image forming device body to the front side in the axial direction, but also other operations. For example, if the image forming device body includes an opening/closing unit that is described later, the detachment operation includes an operation of opening the opening/closing unit before the developing unit is pulled out of the mounting portion.

In addition, the expression "in association with a detachment operation" includes not only a situation in which the entire detachment operation is performed but also a situation in which a portion of the detachment operation is performed. Therefore, for example, if the image forming device body includes an opening/closing unit, the first developing roller may be moved to a retracted position from the photosensitive drum when the opening/closing unit is opened before the developing unit is pulled out of the mounting portion. In addition, the first developing roller may not be moved to a retracted position from the photosensitive drum when the opening/closing unit is opened, but may be moved to a retracted position from the photosensitive drum when the developing unit is pulled out of the mounting portion after the opening/closing unit is opened.

According to a second aspect of the present invention, the developing unit in accordance with the first aspect of the present invention further comprises a second developing roller that is arranged in a position proximate to the first developing roller and configured to supply toner to the first developing roller.

According to the second aspect of the present invention, operability can be improved particularly for the developing unit in which two-component developer can be used (hereinafter referred to as a hybrid developing unit), for instance.

According to a third aspect of the present invention, in the developing unit in accordance with the second aspect of the present invention, the body of the image forming device comprises a mounting portion that is formed adjacent to the photosensitive drum to extend in the axial direction of the photosensitive drum. In addition, the mounting portion comprises a contact portion that is formed on the rear end in the axial direction. Furthermore, the roller contacting/retracting mechanism comprises at least one arm member, a shaft member, and at least one bearing member. The arm member is mounted to the roller contacting/retracting mechanism so that it rotates together with the second developing roller. The shaft member is configured to extend and be movable in the axial direction, comprising a first contact portion that can contact a contact portion of the image forming device body on a rear side end portion thereof in the axial direction, and configured to rotate at least one arm member together with the second developing roller when moving in the axial direction. At least one bearing member is configured to support the rotation shafts of the first and second developing rollers.

The developing unit is mounted to the mounting portion of the image forming device body when pushed to the rear side of the image forming device body in the axial direction. However, the first contact portion of the shaft member contacts the contact portion of the image forming device body and accordingly the shaft member moves to the front side in the axial direction in association with the attachment operation of the developing unit to the image forming device body. Because of this, at least one arm member rotates together with the second developing roller. At the same time as this, the first developing roller rotates around the second developing roller functioning as the rotation center through at least one bearing member, and thus moves to a position proximate to the photosensitive drum.

According to a fourth aspect of the present invention, in the developing unit in accordance with the third aspect of the present invention, the roller contacting/retracting mechanism further comprises an urging member. The urging member is configured to urge the shaft member toward the rear side in the axial direction so that the first contact portion thereof protrudes on the rear side in the axial direction when in an unconstrained state.

With this developing unit, the urging force is applied to the shaft member toward the rear side in the axial direction. Therefore, the first contact portion of the shaft member moves away from the contact portion of the image forming device body when the developing unit is detached from the image forming device body. Thus, the shaft member can be returned to the default position. Therefore, the first developing roller can be automatically moved to a retracted position from the photosensitive drum in association with the detachment operation of the developing unit from the image forming device body.

According to a fifth aspect of the present invention, in the developing unit in accordance with the third aspect of the present invention, the at least one arm member comprises two arm members arranged on the front end portion and the rear end portion of the second developing roller in the axial direction, respectively. In addition, the at least one bearing member comprises two bearing members arranged on the front end portion and the rear end portion of the second developing roller in the axial direction, respectively. Furthermore, the shaft member rotates the two arm members together with the second developing roller when moving in the axial direction.

The configuration in which two arm members rotate together in association with the attachment operation of the developing unit to the image forming device body is applied to this developing unit. Therefore, the distance between two bent portions of the shaft member for rotating the two arm members can be reduced, for instance. Accordingly, the moving range of the shaft member in the axial direction can be reduced.

According to a sixth aspect of the present invention, in the developing unit in accordance with the third aspect of the present invention, the at least one arm member comprises two arm members arranged on the front end portion and the rear end portion of the second developing roller in the axial direction, respectively.

In addition, the at least one bearing member comprises two bearing members arranged on the front end portion and the rear end portion of the second developing roller in the axial direction. Furthermore, the shaft member rotates the two arm members at different timings together with the second developing roller when moving in the axial direction.

With this developing unit, two arm members rotate at different timings in association with the attachment operation of the developing unit to the image forming device body. Because of this, both end portions of the first developing roller in the axial direction are separately arranged in positions proximate to the photosensitive drum. Therefore, force for operating the shaft member that is required for operating the attachment operation of the developing unit to the image forming device body can be dispersed. Thus, it is possible to perform the attachment operation with a force that is smaller than that is required for disposing the first developing roller in a position proximate to the photosensitive drum at once.

According to a seventh aspect of the present invention, in the developing unit in accordance with the second aspect of the present invention, the image forming device body comprises a mounting portion that is formed adjacent to the photosensitive drum to extend in the axial direction, and an opening/closing unit that is disposed on the front side of the mounting portion in the axial direction and configured to open and close the mounting portion. In addition, the roller contacting/retracting mechanism comprises at least one arm member, a shaft member, and at least one bearing member. The at least one arm member is mounted to the roller contacting/retracting mechanism so as to be rotatable with the second developing roller. The shaft member extends in the axial direction and is configured to be movable in the axial direction. The shaft member comprises a second contact portion that can contact the opening/closing unit of the image forming device body on a front side end portion thereof in the axial direction. The shaft member is configured to rotate the at least one arm member together with the second developing roller when moving in the axial direction. The at least one bearing member is configured to support the rotation shafts of the first and second developing rollers.

The developing unit is pushed to the rear side of the image forming device body in the axial direction, and then the opening/closing unit is closed. Thus, the developing unit is mounted to the image forming device body. At this time, the second contact portion of the shaft member is pushed and moved to the rear side by the opening/closing unit of the image forming device body. Therefore, the at least one arm member rotates together with the second developing roller and the first developing roller is arranged in proximity to the photosensitive drum.

According to an eighth aspect of the present invention, in the developing unit in accordance with the seventh aspect of the present invention, the roller contacting/retracting mechanism further comprises an urging member configured to urge the shaft member toward the front side in the axial direction so that a second contact portion of the shaft member protrudes on the front side in the axial direction when in an unconstrained state.

With this developing unit, the urging force is applied to the shaft member toward the front side in the axial direction. Therefore, if the opening/closing unit is opened with respect to the mounting portion when the developing unit is detached from the image forming device body, the shaft member can be returned to a default position. Therefore, the first developing roller can be automatically moved to a retracted position from the photosensitive drum in association with the detachment operation of the developing unit from the image forming device body.

According to a ninth aspect of the present invention, in the developing unit in accordance with the seventh aspect of the present invention, the at least one arm member comprises two arm members arranged on the front end portion and rear end portion of the second developing roller in the axial direction, respectively. In addition, the at least one bearing member comprises two bearing members arranged on the front end portion and the rear end portion of the second developing roller in the axial direction, respectively. Furthermore, the shaft member rotates the two arm members together with the second developing roller when moving in the axial direction.

With this developing unit, the configuration in which two arm members rotate together in association with the attachment operation of the developing unit to the image forming device body is applied. Therefore, the distance between two bent portions of the shaft member for rotating the two arm members can be reduced, for instance. Accordingly, the moving range of the shaft member in the axial direction can be reduced.

According to a tenth aspect of the present invention, in the developing unit in accordance with the seventh aspect of the present invention, the at least one arm member comprises two arm members arranged on the front end portion and rear end portion of the second developing roller in the axial direction, respectively. In addition, the at least one bearing member comprises two bearing members arranged on the front end portion and the rear end portion of the second developing roller in the axial direction, respectively. Furthermore, the shaft member rotates together with the second developing roller at a different timing that differs for the two arm members when moving in the axial direction.

According to the developing unit, the two arm members rotate at different timings in association with the attachment operation of the developing unit to the image forming device body. Because of this, both end portions of the first developing roller in the axial direction are separately arranged in positions proximate to the photosensitive drum. Therefore, force for operating the shaft member that is required for operating the attachment operation of the developing unit to the image forming device body can be dispersed. Thus, it is possible to perform the attachment operation with the force that is smaller than that is required for arranging the first developing roller in a position proximate to the photosensitive drum at once.

According to an eleventh aspect of the present invention, the developing unit in accordance with the seventh aspect of the present invention further comprises a casing in which the first and second developing rollers are arranged therein and developer to be supplied to the photosensitive drum is stored. In addition, the opening/closing unit comprises a developer storage portion configured to store developer, and be in communication with the casing when the developing unit is attached to the body of the image forming device.

With this developing unit, when the opening/closing unit is closed, the developer storage portion is in communication with the casing. Furthermore, it is possible to set a stand-by state in which developer can be supplied to the interior of the developing unit from the developer storage portion.

According to a twelfth aspect of the present invention, a developing unit is configured to supply toner to a photosensitive drum in an image forming device and is detachably mounted to the body of an image forming device. In addition, the image forming device body comprises a mounting portion that is formed adjacent to the photosensitive drum and extends in the axial direction of the photosensitive drum, and a contact portion that is formed on the rear side thereof in the axial direction. Furthermore, the developing unit comprises a first developing roller, a second developing roller, and a roller contacting/retracting mechanism. The first developing roller can be disposed in a position proximate to and parallel with the photosensitive drum in the interior of the image forming device body, and can be moved to a position retracted from the photosensitive drum. The second developing roller is arranged in a position proximate to the first developing roller and configured to supply toner to the first developing roller. The roller contacting/retracting mechanism is configured to move the first developing roller to the position proximate to the photosensitive drum when attaching the developing unit to the body of the image forming device, and move the first developing roller to the position retracted from the photosensitive drum when detaching the developing unit from the body of the image forming device. The roller contacting/retracting mechanism comprises at least one arm member, a shaft member, at least one bearing member, and an urging member. The at least one arm member is mounted to the roller contacting/retracting mechanism so as to rotate together with the second developing roller. The shaft member extends in the axial direction and is movable in the axial direction. The shaft member comprises a contact portion that can contact a contact portion of the image forming device body on the rear side end portion thereof in the axial direction, and configured to rotate the at least one arm member together with the second developing roller when moving in the axial direction. The at least one bearing member is configured to support the rotation shafts of the first and second developing rollers. The urging member is configured to urge the shaft member toward the rear side in the axial direction so that the contact portion of the shaft member will protrude on the rear side in the axial direction when in an unconstrained state.

According to a thirteenth aspect of the present invention, an image forming device comprises an image forming device body in which at least one photosensitive drum is arranged therein, and at least one developing unit. The at least one developing unit is configured to supply toner to the photosensitive drum and at least one developing unit is detachably mounted to the body of the image forming device. In addition, the at least one developing unit comprises a first developing roller that can be moved to a position parallel to and proximate to the at least one photosensitive drum and a position retracted from at least one photosensitive drum, and a roller contacting/retracting mechanism configured to move the first developing roller to the position proximate to the at least one photosensitive drum when the at least one developing unit is attached to the body of the image forming device, and move the first developing roller to the position retracted from the at least one photosensitive drum when the at least one developing unit is detached from the image forming device body.

According to a fourteenth aspect of the present invention, in the image forming device in accordance with the thirteenth aspect of the present invention, the at least one photosensitive drum comprises four photosensitive drums. In addition, the at least one developing unit comprises four developing units arranged to correspond to the four photosensitive drums, respectively.

According to the present invention, the developing roller is automatically moved to be in a position proximate to or a position retracted from the photosensitive drum when the developing unit is attached to/detached from the body of the image forming device. Therefore, it is possible to simultaneously attach/detach the developing unit to/from the image forming device body and move the developing roller to be in a position proximate to/retracted from the photosensitive drum. Accordingly, operability of the developing unit can be improved and erroneous operation thereof can be inhibited.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Color Printer

Figure 1:
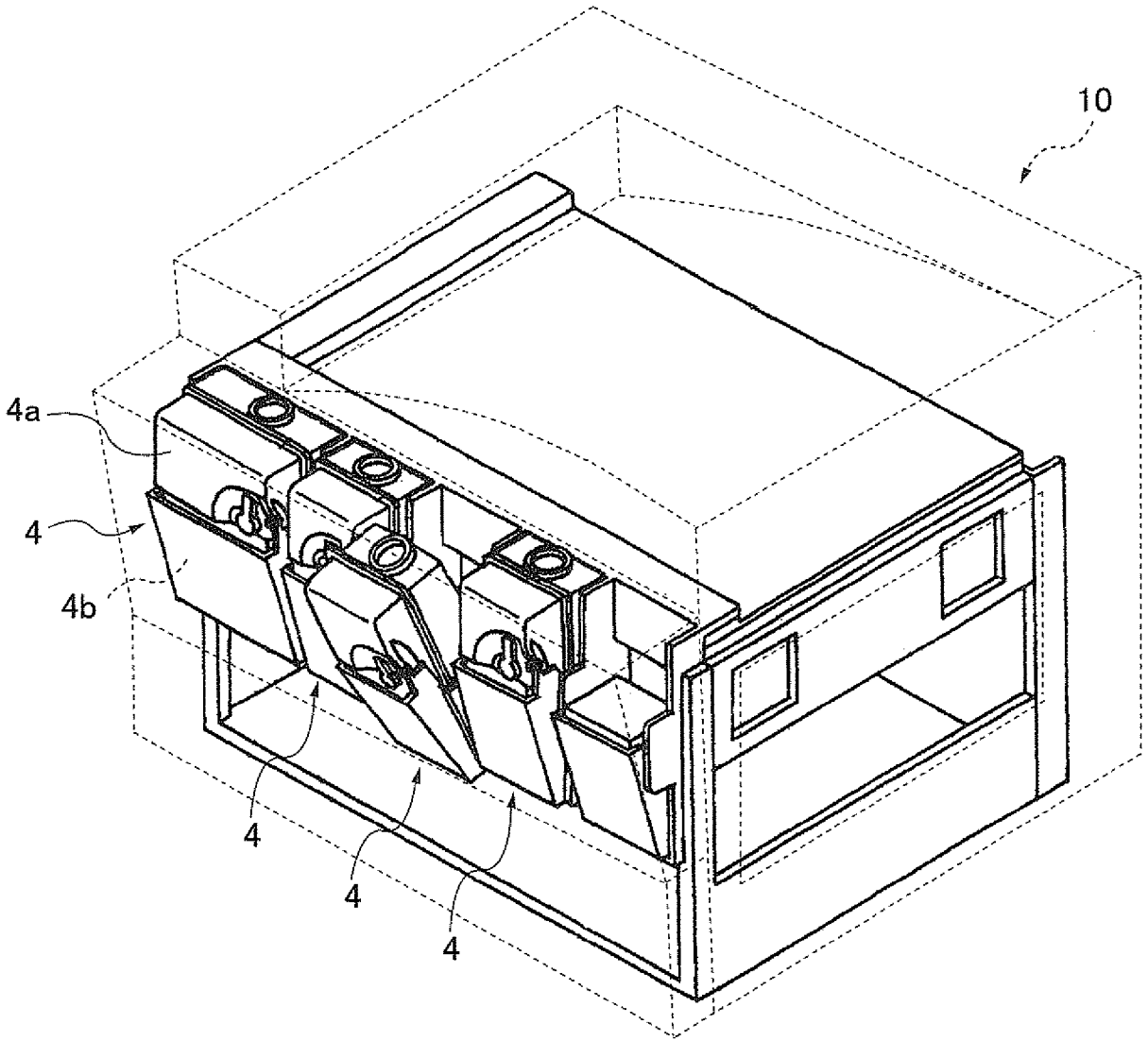
FIG. 1 is perspective view showing the interior of a printer to which a first embodiment of the present invention is applied.
Figure 2:
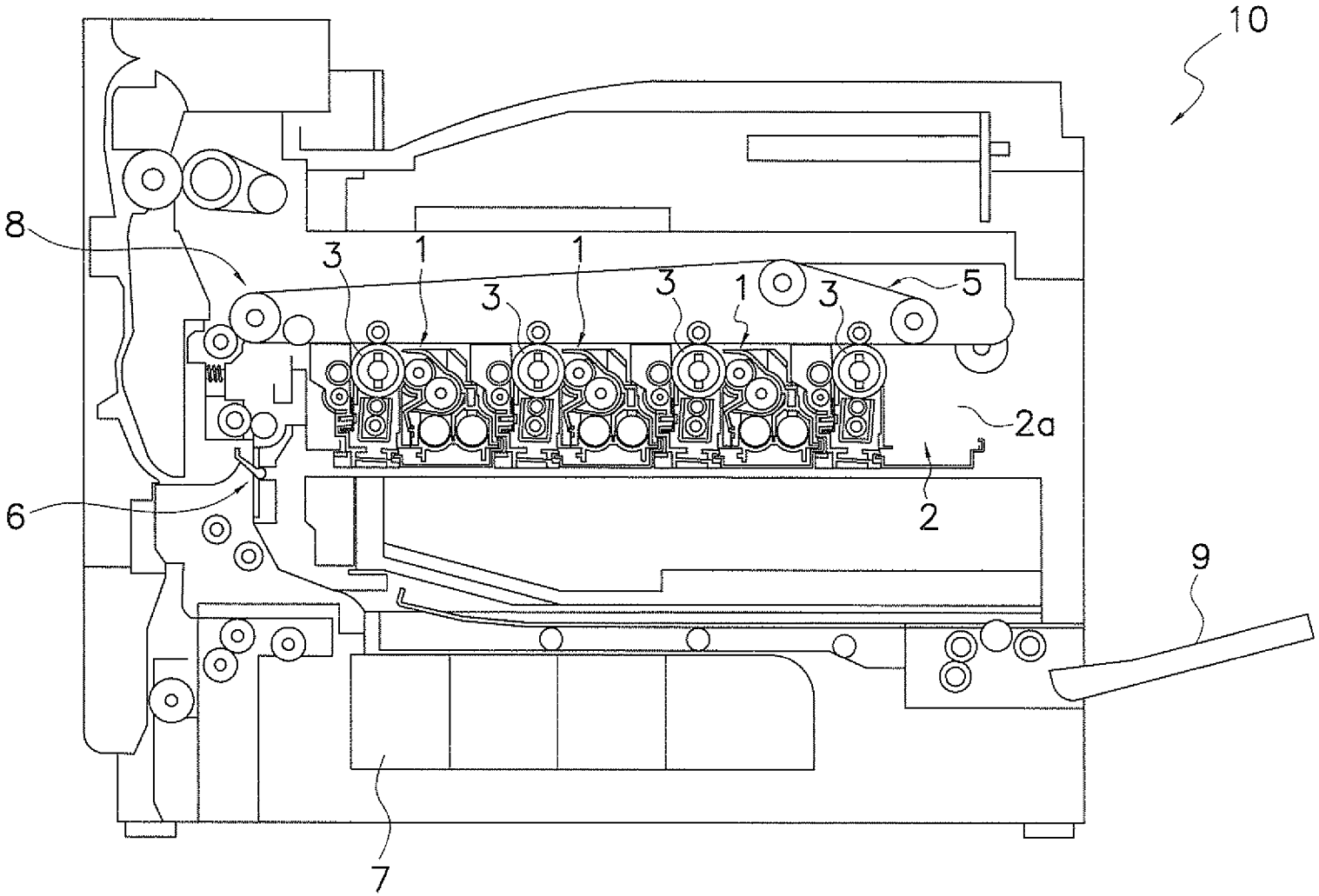
FIG. 2 shows a longitudinal cross-section of the printer.

FIGS. 1 and 2 show a tandem color printer 10 (i.e., an image forming device) to which the first embodiment of the present invention is applied. The color printer 10 comprises a developing unit 1 (i.e., a developing device) and a printer body (i.e., an image forming device body) to which the developing unit 1 is mounted. Note that only three developing units 1 are shown in FIG. 2 but a total of four developing units 1 can be mounted to this printer body.

The printer body comprises four photosensitive drums 3, each of which corresponds to four color toners (i.e., cyan, magenta, yellow, and black), four developing units 1, an intermediate transfer belt 5, four unit mounting portions 2, and four toner storage units 4 (i.e., opening/closing units).

Each of the photosensitive drums 3 serves to support a toner image composed of toner on the surface thereof, and transfer the toner image to the intermediate transfer belt 5.

The intermediate transfer belt 5 is an endless belt that is arranged in the interior of the printer body to extend in the horizontal direction. The intermediate transfer belt 5 is circularly driven in association with an image forming operation. A transfer unit 8 transfers the toner image on the intermediate transfer belt 5 to a recording medium (such as a sheet of paper) that is transported through a paper transport path 6 from a paper supply cassette 7 or a bypass tray 9.

Each of the unit mounting portions 2 is formed adjacent to each of the photosensitive drums 3 to extend in the axial direction of the rotational axis of the photosensitive drum 3 (hereinafter simply referred to as "the axial direction"). The developing unit 1 can be detachably mounted to the unit mounting portion 2. The developing unit 1 can be moved in the axial direction when attached to or detached from the unit mounting portion 2. The unit mounting portion 2 comprises a contact portion 2*a* that is arranged on the rear side in the axial direction.

Figure 3:
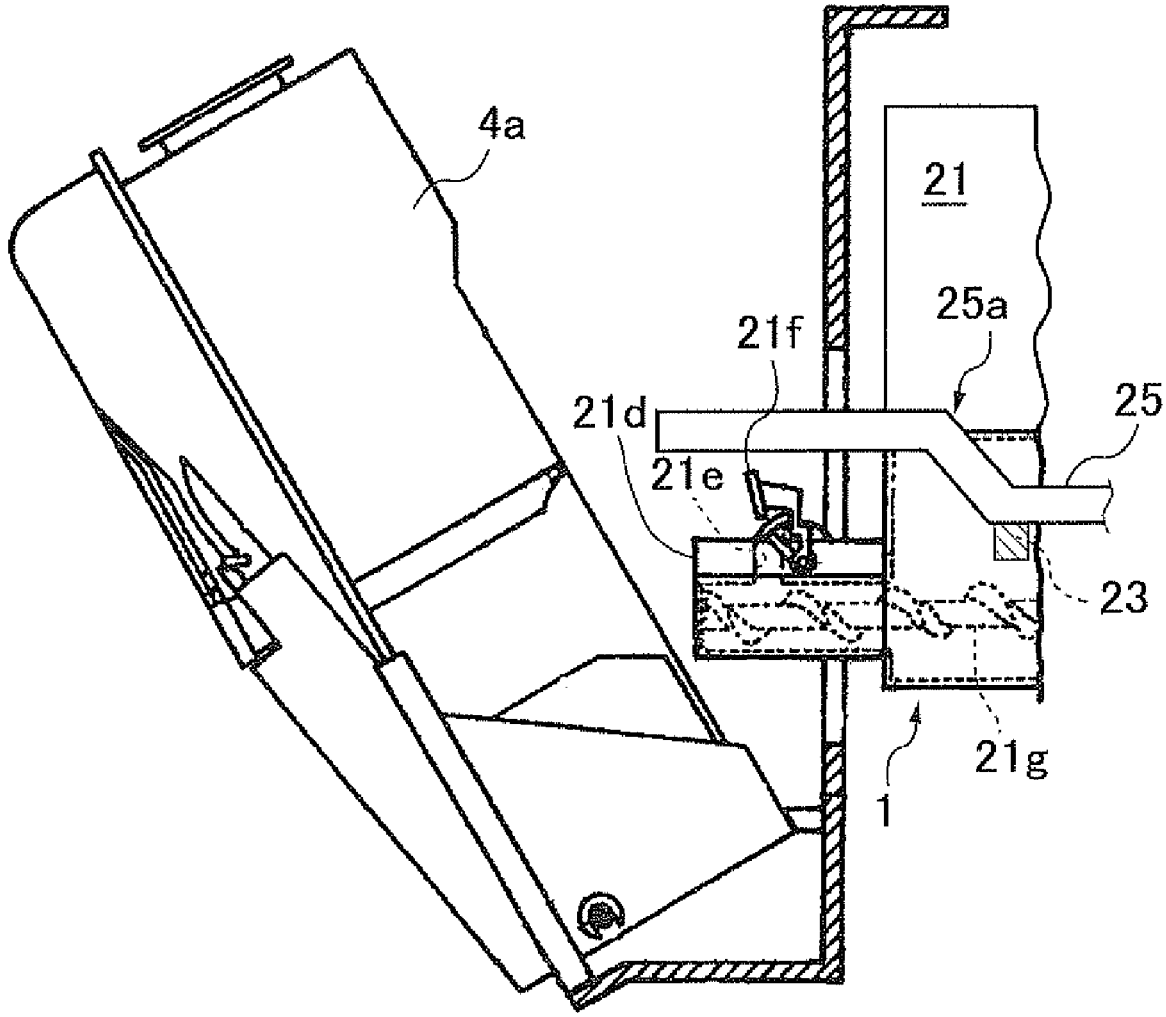
FIG. 3 shows the relevant portions in a longitudinal cross-section of a developing unit of the printer, in a state in which the developing unit is mounted to the body of the printer.
Figure 4:
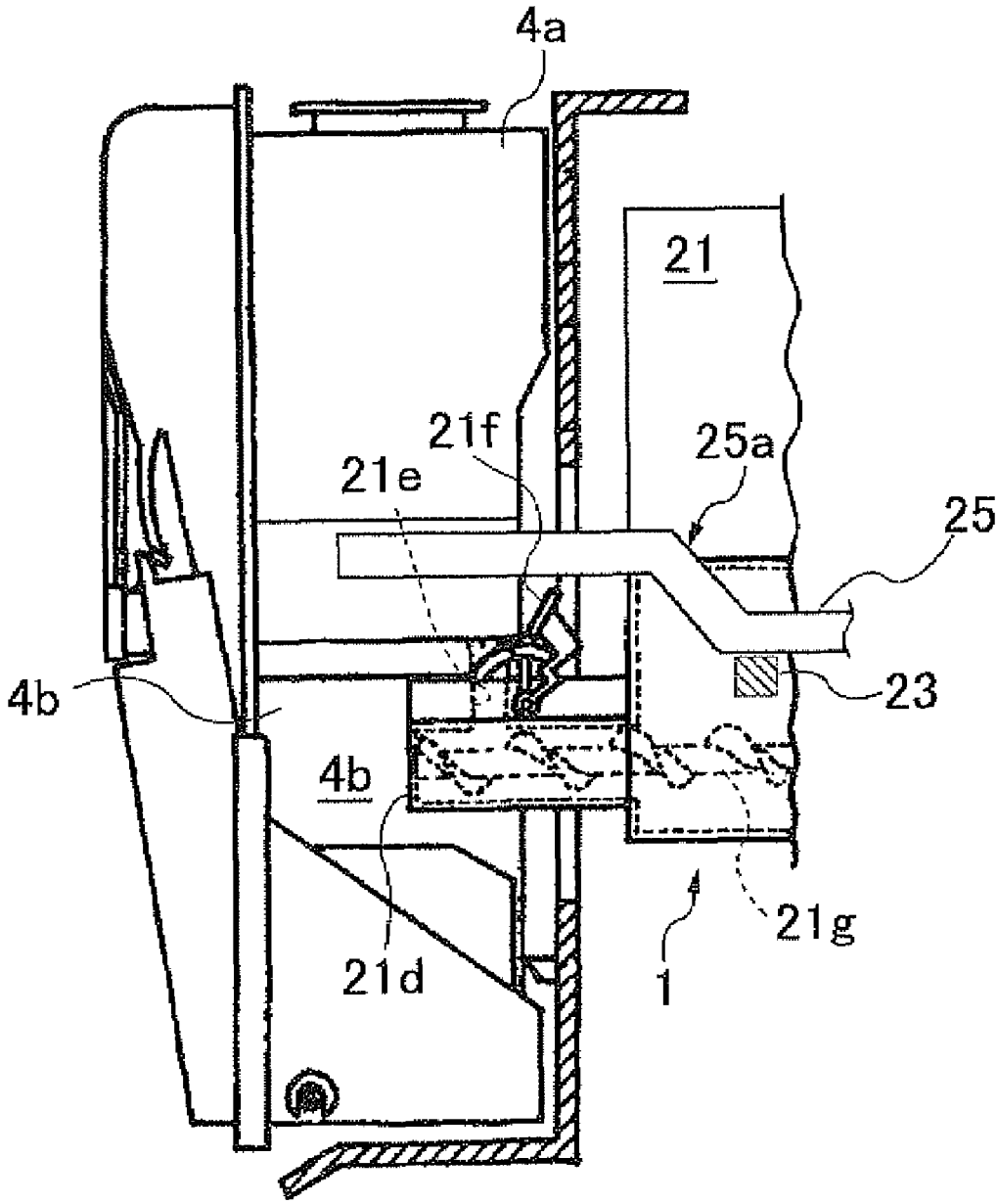
FIG. 4 shows the relevant portions in a longitudinal cross-section of a developing unit of the printer, in a state in which the developing unit is mounted to the body of the printer.

Each of the toner storage units 4 is arranged on the front side of the unit mounting portion 2 in the axial direction. As shown in FIGS. 3 and 4, the lower end portion of each of the toner storage units 4 is mounted to the end portion of the printer body that is located on the front side of the unit mounting portion 2, and is mounted such that it is able to freely open and close. Each of the toner storage units 4 comprises a toner cartridge 4*a* in which unused toner is filled, and a toner recovery unit 4*b* in which the toner recovered from the photosensitive drum 3 is stored, both of which are developer storage units. The toner cartridge 4*a* can be attached to/detached from the toner recovery unit 4*b*. In addition, a predetermined space is secured in a portion of the lower region of the toner cartridge 4*a*. When the toner storage unit 4 is closed, the predetermined space is configured to incorporate a toner supply portion 21*d* (described below) and a shutter 21*f* (described below) will be opened via the lower end portion of the toner cartridge 4*a*, and the toner cartridge 4*a* will be in communication with the casing 21. Accordingly, the toner stored in the toner cartridge 4*a* will be supplied to the interior of the casing 21.

Developing Unit

Figure 5:
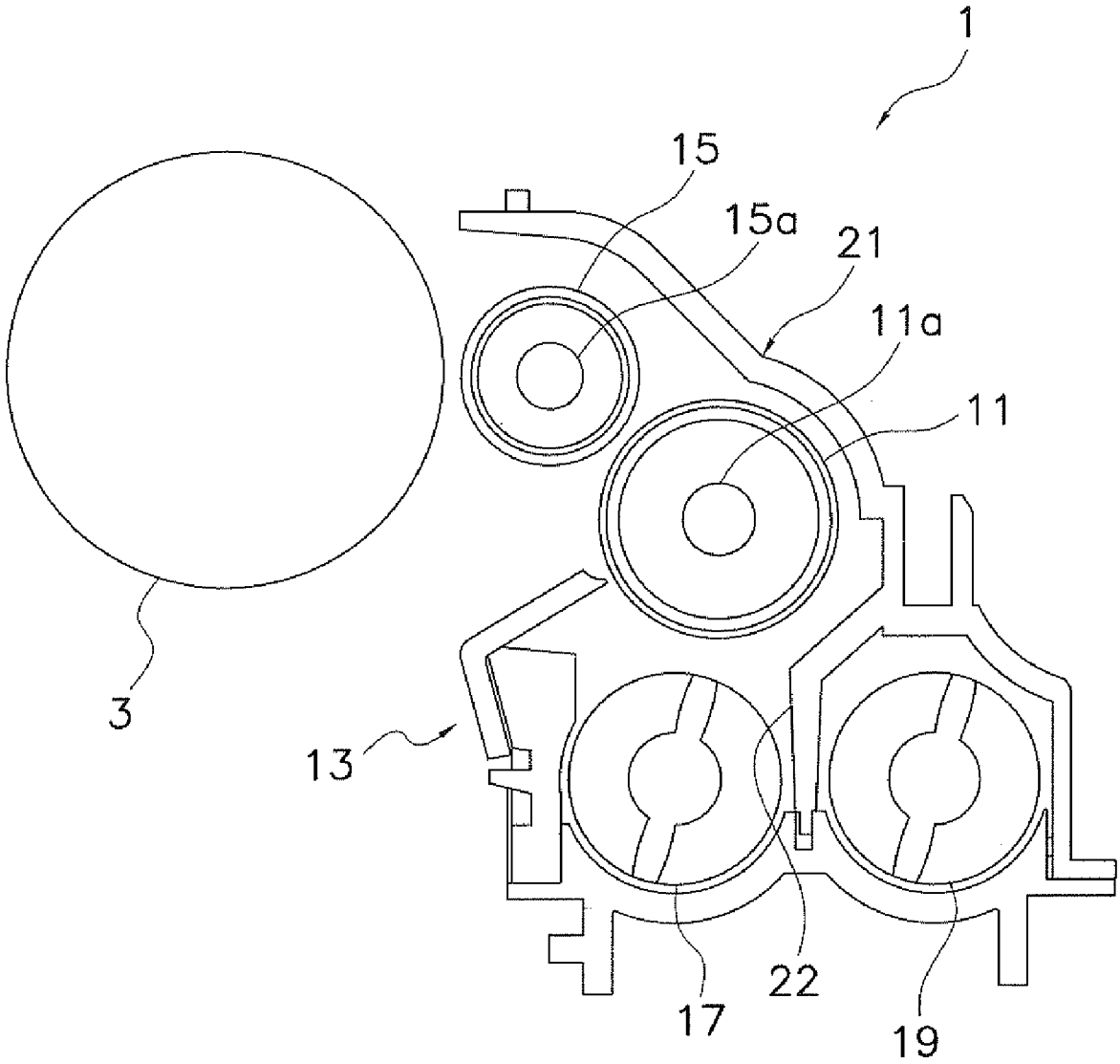
FIG. 5 shows a longitudinal cross-section of the developing unit.

FIG. 5 shows a developing unit 1.

Only one of the four developing units 1 that can be mounted in the printer body will be hereinafter explained. However, four developing units 1 are configured to be the same except that toner colors to be used in the four developing units 1 are different from each other.

The developing unit 1 serves to provide the photosensitive drum with a predetermined color toner. The developing unit 1 is a hybrid developing unit in which two-component developer can be used. The developing unit 1 comprises a first developing roller 15, a second developing roller 11, a blade 13, a roller contacting/retracting mechanism 16, agitation members 17 and 19, and the casing 21 that accommodates these units/members.

The second developing roller 11 comprises magnetic poles that are arranged in a plurality of positions in the circumferential direction thereof. The second developing roller 11 is configured to draw and peel off developer while rotating.

The blade 13 is a member for controlling the thickness of the developer drawn onto the second developing roller 11.

The first developing roller 15 is arranged in proximity to the second developing roller 11. In addition, the first developing roller 15 can be arranged in proximity to the photosensitive drum 3 in the interior of the printer 10. The first developing roller 15 is driven to rotate in association with an image forming operation. The first developing roller 15 can draw developer from the second developing roller 11. In addition, the first developing roller 15 can be moved to be in proximity to or retracted from the photosensitive drum 3 via a roller contacting/retracting mechanism 16.

Gap rolls 14 are mounted to both end portions of the first developing roller 15 in the axial direction. In addition, an urging mechanism (not shown in the drawings) that applies an urging force toward the photosensitive drum 3 is mounted to the first developing roller 15. Because of this, when the developing unit 1 is attached to the printer body, the gap rolls 14 will be in contact with both end portions of the photosensitive drum 3 in the axial direction. Thus, the distance between the photosensitive drum 3 and the first developing roller 15 is kept constant.

Each of the agitation members 17 and 19 is comprised of a shaft extending in the axial direction and a helical blade formed on the outer periphery of the shaft, and is arranged on the bottom portion of the casing 21 to be parallel to each other. The agitation members 17 and 19 are driven to rotate in association with the image forming operation. Accordingly, the agitation members 17 and 19 can circulate developer within the casing 21 through a partition wall 22 that is arranged between the agitation members 17 and 19 in the radial direction.

The first developing roller 15 and the second developing roller 11 are arranged in the interior of the casing 21, and developer is also filled therein. Guide members 21*a* and 21*b* are arranged on both end portions of the casing 21 in the axial direction. The guide members 21*a* and 21*b* serve to support the movement of a shaft member 25 in the axial direction. In addition, a support member 21*c* is provided between the guide members 21*a* and 21*b* in the axial direction. The support member 21*c* serves to support predetermined portion(s) of the urging member 26. In addition, as shown in FIGS. 3 and 4, the toner supply portion 21*d* for receiving toner supplied from the toner cartridge 4*a* is formed on the front side end portion of the casing 21. The toner supply portion 21*d* comprises a toner inlet 21*e* and the shutter 21*f* for opening/closing the toner inlet 21*e*. The shutter 21*f* is opened by the toner cartridge 4*a* when the toner storage unit 4 is mounted to the unit mounting portion 2. The toner supplied to the interior of the casing 21 from the toner cartridge 4*a* is transported to the rear side in the axial direction by a toner transport screw 21*g* that is arranged in the interior of the casing 21.

Roller Contacting/Retracting Mechanism

Figure 6:
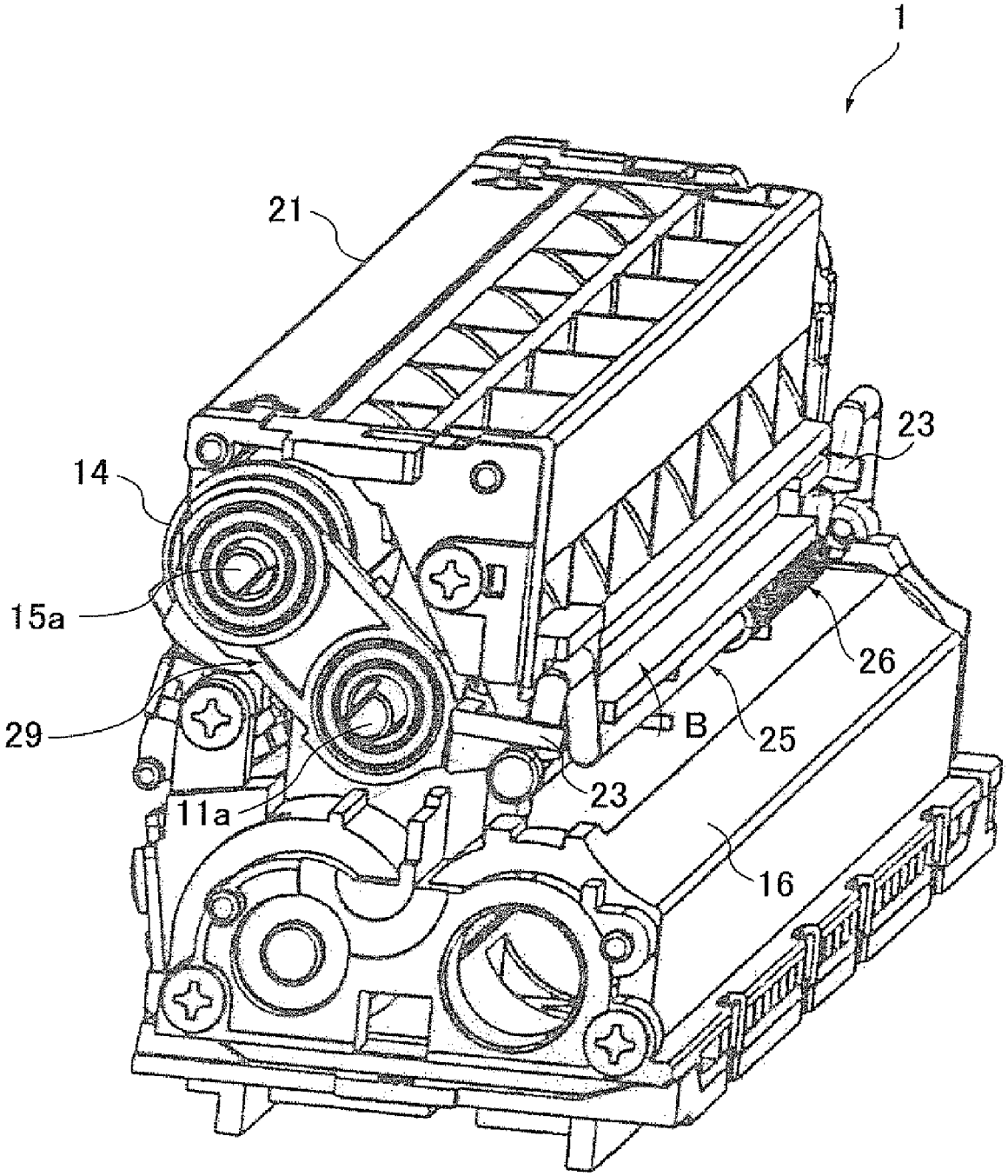
FIG. 6 shows a perspective view of the developing unit.
Figure 7:
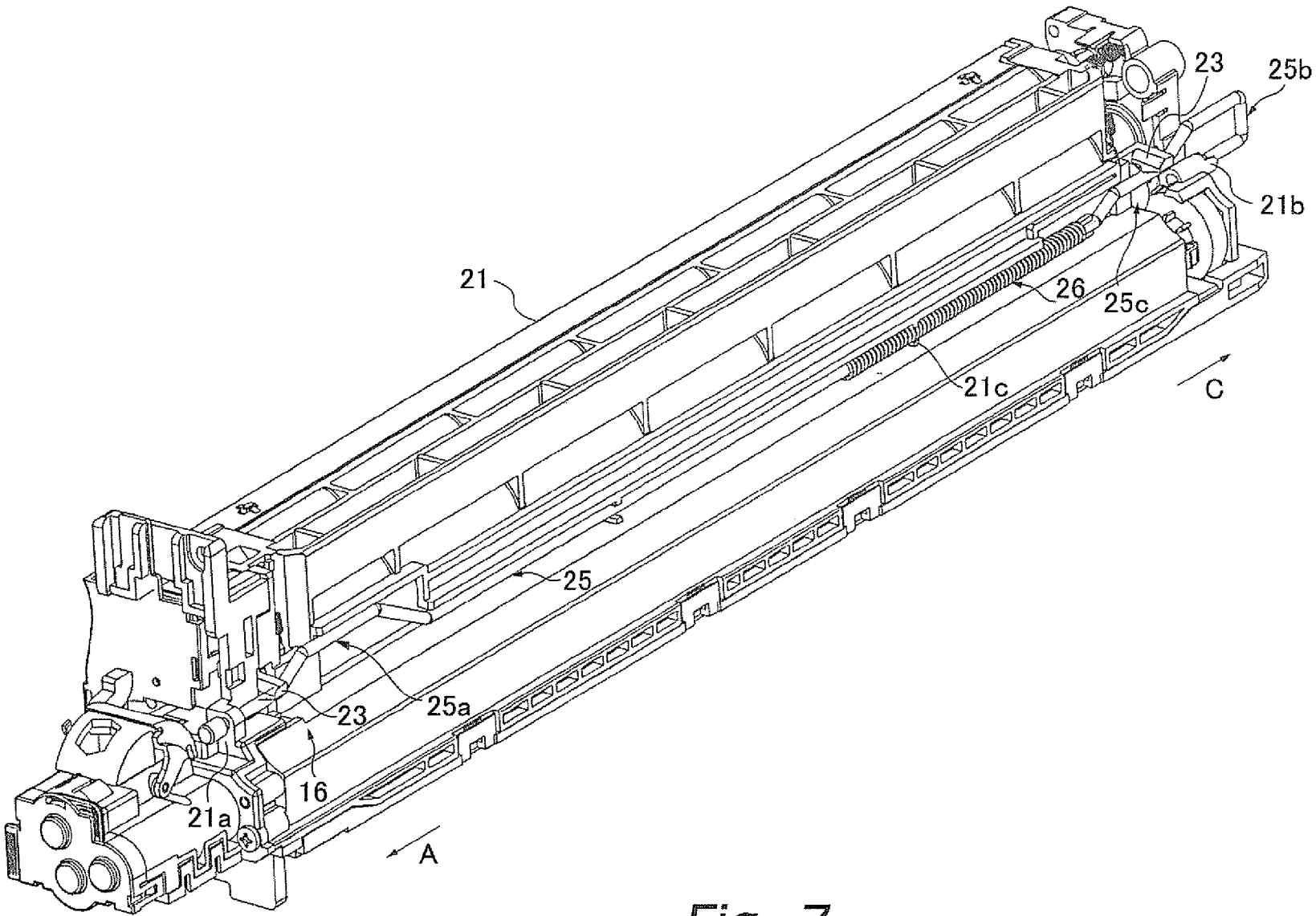
FIG. 7 shows a perspective view of the developing unit.

FIGS. 6 and 7 show the roller contacting/retracting mechanism 16.

The roller contacting/retracting mechanism 16 is a mechanism that is operated to move the first developing roller 15 to a position proximal to or a position retracted from the photosensitive drum 3. The roller contacting/retracting mechanism 16 comprises two arm members 23, the shaft member 25, the urging member 26, and two bearing members 29.

The arm members 23 are mounted on both end portions of a rotation shaft 15*a* so that it can rotate along with the first developing roller 15. In an unconstrained state, an urging means such as a spring (not shown in the drawings) applies an urging force to each of the arm members 23 in a direction in which each of the arm members 23 contacts the shaft member 25 from above. However, the tip of each of the arm members 23 is configured to resist the urging force and be pushed up by two bent portions 25*a* and 25*c* of the shaft member 25 (described below).

The shaft member 25 is comprised of a material with a predetermined stiffness. In addition, it is a rod-like member extending in the axial direction and movably arranged in the axial direction. The shaft member 25 includes the two bent portions 25*a* and 25*c*, both of which bent upward. When the shaft member 25 moves to the front side in the axial direction (i.e., a direction indicated by arrow A in FIG. 7), the tip of each of the arm members 23 is pushed up in a direction indicated by arrow B shown in FIG. 6 at a different timing from each other. Accordingly, each of the arm members 23 will be rotated. Specifically, the shaft member 25 is configured so that the arm member 23 on the rear side is pushed up by the bent portion 25*c* ahead of the arm member 23 on the front side and then the arm member 23 on the front side is pushed up by the bent portion 25*a*.

In addition, the shaft member 25 comprises a contact portion 25*b* on the rear side end portion thereof in the axial direction. The contact portion 25*b* can contact the contact portion 2*a* of the printer body. As shown in the drawings, the contact portion 25*b* is a U-shaped portion formed by bending back a portion of the shaft member 25 in the axial direction. Note that both end portions of the shaft member 25 in the axial direction are inserted into and passed through the guide members 21*a* and 21*b* in the casing 21.

The urging member 26 serves to urge the shaft member 25 to the rear side in the axial direction (i.e., a direction indicated by arrow C shown in FIG. 7). Here, a coil spring is used as the urging member 26. The shaft member 25 is inserted into and passed through the inner peripheral side of the coil spring. The support members 21*c* support the coil spring in predetermined positions. In an unconstrained state, the coil spring urges the shaft member 25 so that the contact portion 25*b* of the shaft member 25 is arranged to protrude toward the rear side in the axial direction.

Each of the bearing members 29 is integrally formed with the arm member 23 and functions as a link member that supports the rotation shaft 15*a* of the first developing roller 15 and a rotation shaft 11*a* of the second developing roller 11 and links the first and the second developing rollers 15 and 11. The bearing member 29 is configured to integrally rotate with the second developing roller 11. Therefore, when the second developing roller 11 rotates along with the arm member 23, the first developing roller 15 is pulled by the bearing member 29, and rotates around the second developing roller 11 functioning as the rotation center. Accordingly, the first developing roller 15 is moved to a position proximal to or retracted from the photosensitive drum 3. Note that the bearing member 29 may be a member separately formed from the arm member 23.

Operation of Developing Unit

Next, the operation of the developing unit 1 will be hereinafter explained.

When mounting the developing unit 1 in the printer body, the toner storage unit 4 will be swung open to the front side, and then the toner cartridge 4*a* is detached from the toner recovery unit 4*b*. In this state, the developing unit 1 will be pushed to the rear side of the unit mounting portion 2 of the printer body in the axial direction. Accordingly, the contact portion 25*b* of the shaft member 25 contacts the contact portion 2*a* of the unit mounting portion 2. Then, the contact portion 25*b* resists the urging force applied by the urging member 26 and moves to the front side in the axial direction. Thus, the tip of the arm member 23 on the rear side is first pushed up by the bent portion 25*c* and rotates along with the second developing roller 11. In addition, the rear side end portion of the first developing roller 15 rotates around the second developing roller 11 functioning as the rotation center, and is disposed in proximity to the photosensitive drum 3. Next, the tip of the arm member 23 on the front side is pushed up by the bent portion 25*a* and rotates along with the second developing roller 11. Accordingly, the front side end portion of the first developing roller 15 also rotates around the second developing roller 11 functioning as the rotation center, and is disposed in proximity to the photosensitive drum 3. Here, the gap rolls 14 are in contact with the photosensitive drum 3. Thus, the distance between the photosensitive drum 3 and the first developing roller 15 will be kept constant. Finally, the toner cartridge 4*a* is attached to the toner recovery unit 4*b*, then the toner storage unit 4 is pulled back up, and the unit mounting portion 2 is closed.

On the other hand, when detaching the developing unit 1 from the printer body, the toner storage unit 4 is first swung open to the front side, and then the toner cartridge 4*a* is detached from the toner recovery unit 4*b*. After this, the developing unit 1 is pulled to the front side in the axial direction, which is the opposite of the attachment operation thereof to the printer 10. Accordingly, the urging member 26 applies an urging force to the shaft member 25, and the shaft member 25 is moved to the rear side in the axial direction. Because of this, the tip of the arm member 23 on the front side is first released from the pushed-up state maintained by the bent portion 25*a*, and rotates along with the second developing roller 11 in a direction opposite from the rotational direction in the attachment operation of the developing unit 1 to the printer body. Then, the front side end portion of the first developing roller 15 rotates around the second developing roller 11 functioning as the rotation center, and is disposed in a retracted position from the photosensitive drum 3. Next, the tip of the arm member 23 on the rear side is released from the pushed-up state maintained by the bent portion 25*c*. Because of this, the rear side end portion of the first developing roller 15 also rotates around the second developing roller 11 functioning as the rotation center, and is disposed in a retracted position from the photosensitive drum 3. Through the above described series of actions, it is possible to prevent the first developing roller 15 from striking the photosensitive drum 3 and from scratching the surface of the photosensitive drum 3 when the detachment operation of the developing unit 1 from the printer body is performed.

According to the above described developing unit 1, the first developing roller 15 is automatically moved to a position proximal to or retracted from the photosensitive drum 3 in association with the attachment/detachment operation of the developing unit 1 to/from the printer body. Therefore, it is possible to simultaneously attach the developing unit 1 to the printer body and arrange the first developing roller 15 in a proximal position to the photosensitive drum 3. Thus, the operability of the developing unit 1 can be improved and erroneous operations can be inhibited.

Furthermore, the two arm members 23 are pushed up at different timings. Therefore, both end portions of the first developing roller 15 are separately disposed in proximal positions to the photosensitive drum 3. Accordingly, the force for operating the shaft member 25, which is required for attaching the developing unit 1 to the printer body, can be dispersed. Thus, it is possible to attach the developing unit 1 to the printer body with a smaller amount of operation force than the operation force required for arranging the first developing roller 15 in a proximal position to the photosensitive drum 3.

Modification of the First Embodiment

As a modification of the first embodiment of the present invention, the shaft member may be formed in a shape in which two arm members are simultaneously pushed up in association with the attachment operation of the developing unit 1 to the printer body. In this case, the distance between two bent portions of the shaft member in the axial direction can be reduced. Therefore, it is possible to reduce the length of the shaft member in the axial direction as a whole. Because of this, the moving range of the shaft member can be reduced.

Other embodiments of the present invention will now be described by focusing on the differences with the above described first embodiment of the present invention. In view of the similarity between the first embodiment and the other embodiments, the portions of the other embodiments that are identical to the first embodiment will be given the same reference numerals. Moreover, the descriptions of the portions of other embodiments that are identical to the first embodiment may be omitted for the sake of brevity.

Second Embodiment

Here, the second embodiment of the present invention will be explained in detail by focusing on the differences with the first embodiment.

Figure 8:
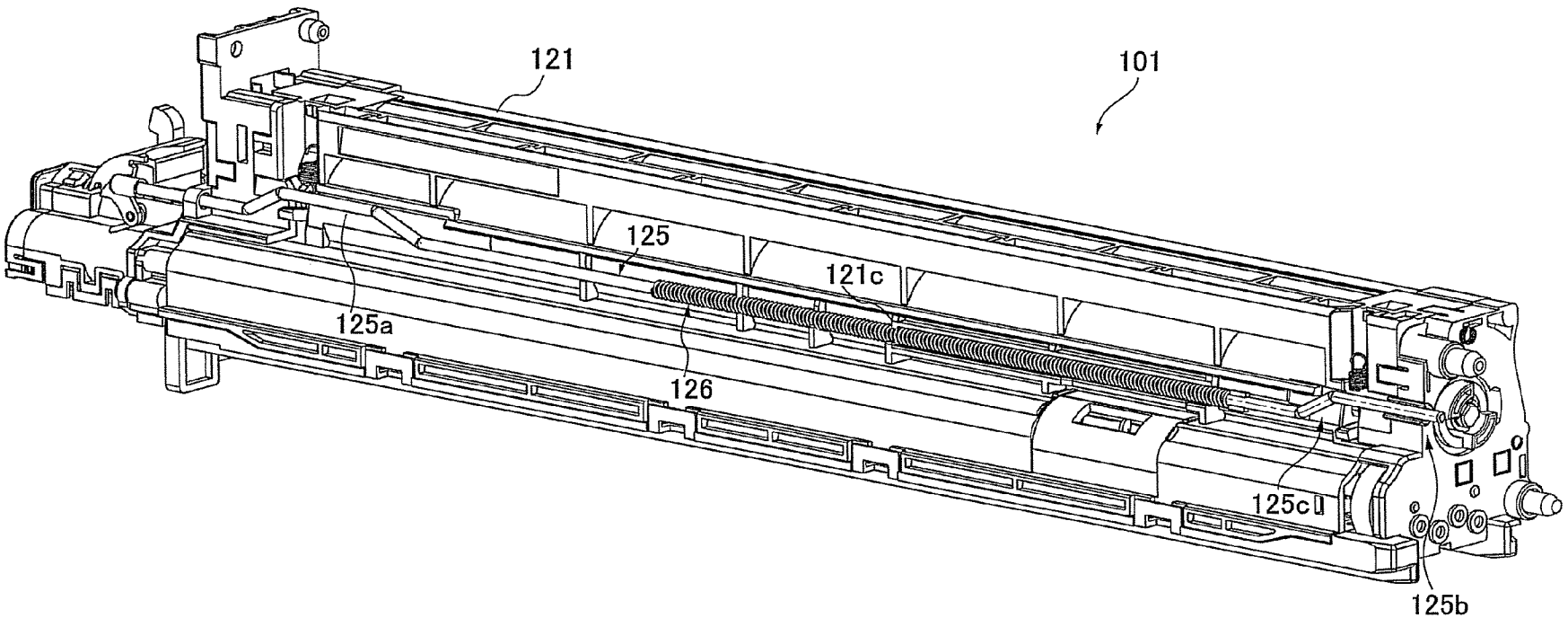
FIG. 8 shows a perspective view of a developing unit to which a second embodiment of the present invention is applied.
Figure 9:
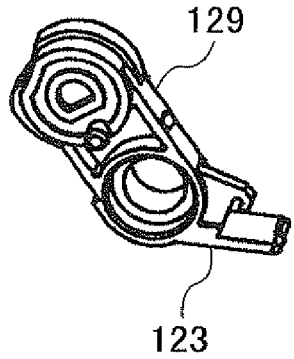
FIG. 9 shows an arm member and a bearing member of the developing unit shown in FIG. 8.
Figure 10:
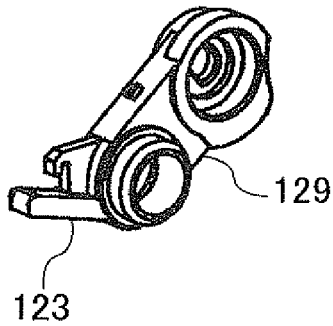
FIG. 10 shows the arm member and bearing member of FIG. 9 when viewed from another side thereof.

FIG. 8 shows a developing unit 101 mounted to a printer body to which the second embodiment of the present invention is applied. In addition, FIGS. 9 and 10 show the appearance of an arm member 123 and a bearing member 129 of the developing unit 101.

In the second embodiment, the tips of two arm members 123 are arranged below a shaft member 125. In addition, in an unconstrained state, an urging means such as a spring (not shown in the drawings) applies an urging force to each of the arm members 123 so that the tip of each of the arm members 123 moves upward. However, the tips of the arm members 123 are configured to be moved upward by two bent portions 125*a* and 125*c*, respectively, in association with the attachment operation of the developing unit 101 to the printer body, and are also configured to resist the urging force applied by the urging means and be pushed down in association with the detachment operation of the developing unit 101 from the printer body.

The shaft member 125 in the present embodiment comprises two bent portions (i.e., the bent portions 125*a* and 125*c*) as with the above described first embodiment. However, the shaft member 125 in the present embodiment is configured to simultaneously move these two arm members 123 upward in association with the attachment and detachment operations of the developing unit 101 to the printer body. In addition, a contact portion 125*b* of the shaft member 125 in the present embodiment is not a U-shaped portion formed by folding back a portion of the shaft member 125, as in the above described first embodiment. It is formed in a linear shape and extends in the axial direction.

Note that in FIG. 8, since the gap rolls 14 are in contact with the photosensitive drum 3, the tip of each of the arm members 123 is arranged below the shaft member 125 with a slight gap therebetween.

The remaining configuration of the developing unit 101 is the same as that of the developing unit 1 described in the first embodiment.

Figures 11A, 11B:
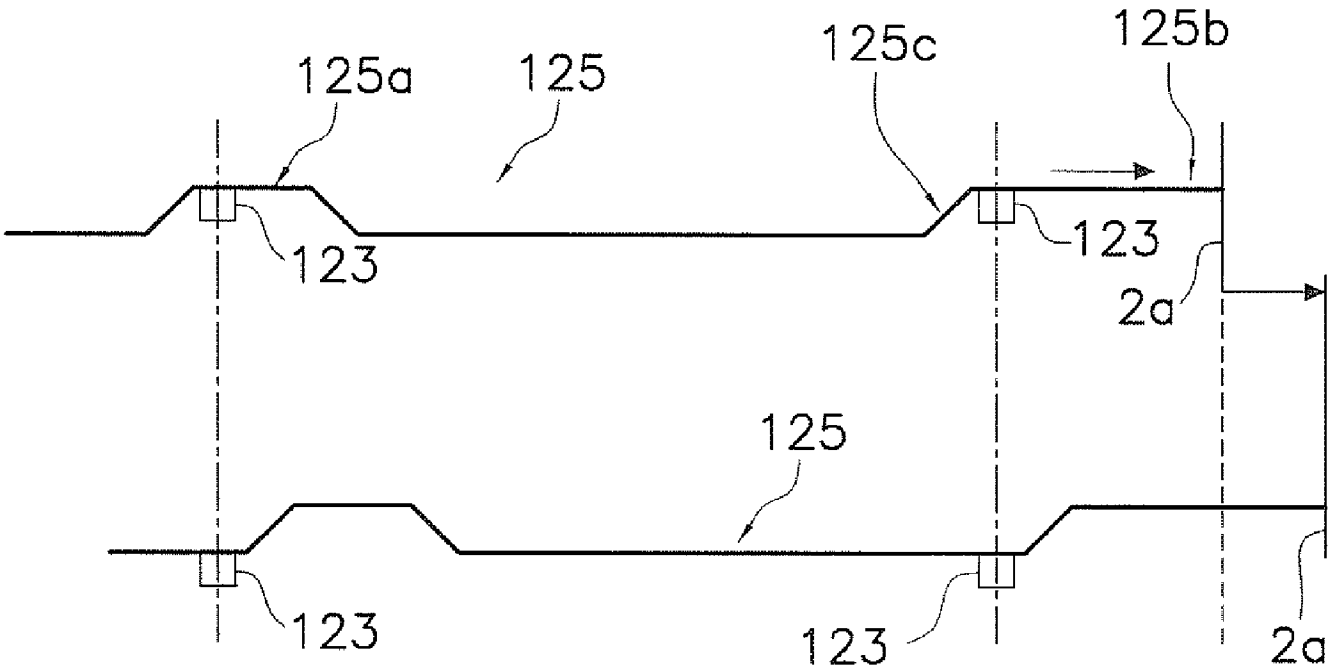
FIG. 11 shows (a) the attachment state of the developing unit to the body of the printer, and (b) the detachment state of the developing unit to the body of the printer, both of which show the movement of the arm member in association with movement of the shaft member in the second embodiment of the present invention.

Next, the attachment and detachment of the developing unit 101 to/from the printer body will be hereinafter explained with reference to FIG. 11. Note that the left side of FIG. 11 corresponds to the front side in the axial direction, and the right side thereof corresponds to the rear side in the axial direction.

When attaching the developing unit 101 to the printer body, the toner storage unit 4 is swung open to the front side, and then a toner cartridge 4*a* is detached from the toner storage unit 4, as with the above described first embodiment. In this state, the developing unit 101 will be pushed to the rear side of the unit mounting portion 2 of the printer body in the axial direction. Accordingly, the contact portion 125*b* of the shaft member 125 will contact the contact portion 2*a* of the printer body, and thus the shaft member 125 will move to the front side in the axial direction toward the casing 121. At this time, two arm members 123 will be moved upward by the bent portions 125*a* and 125*c* of the shaft member 125 at the same time. Because of this, as shown in diagram (a) of FIG. 11, the first developing roller 15 will be arranged in proximity to the photosensitive drum 3. Note that the tips of the arm members 123 are shown to contact the shaft member 125 in diagram (a) of FIG. 11 for convenience. Finally, the toner cartridge 4*a* is attached to the toner storage unit 4, the toner storage unit 4 is pulled back up, and the unit mounting portion 2 is closed. The attachment of the developing unit 101 to the printer body is completed.

On the other hand, when detaching the developing unit 101 from the printer body, the toner storage unit 4 is swung open to the front side, and then the toner cartridge 4*a* is detached from the toner storage unit 4, as with the above described first embodiment. After this, the developing unit 101 will be pulled to the front side in the axial direction. Accordingly, an urging member 126 will apply an urging force to the shaft member 125, and the shaft member 125 will move to the rear side in the axial direction toward the casing 121. At this time, as shown in diagram (b) of FIG. 11, two arm members 123 are simultaneously pushed down by the bent portions 125*a* and 125*c* of the shaft member 125. Because of this, the first developing roller 15 will be arranged in a retracted position from the photosensitive drum 3.

According to the above described developing unit 101, two arm members 123 are configured to be simultaneously moved upward. Therefore, it is possible to reduce the gap between two bent portions 125*a* and 125*c* of the shaft member 125. Because of this, it is possible to reduce the entire length of the shaft member 125, and accordingly reduce the moving range of the shaft member 125 when it is being operated, as with the above described modification of the first embodiment.

Modification of the Second Embodiment

As a modification of the second embodiment of the present invention, two bent portions 125*a* and 125*c* of the shaft member 125 may be configured to move the tips of two arm members 123 upward at different timings, as with the first example of the above described first embodiment.

Figures 12A, 12B, 12C:
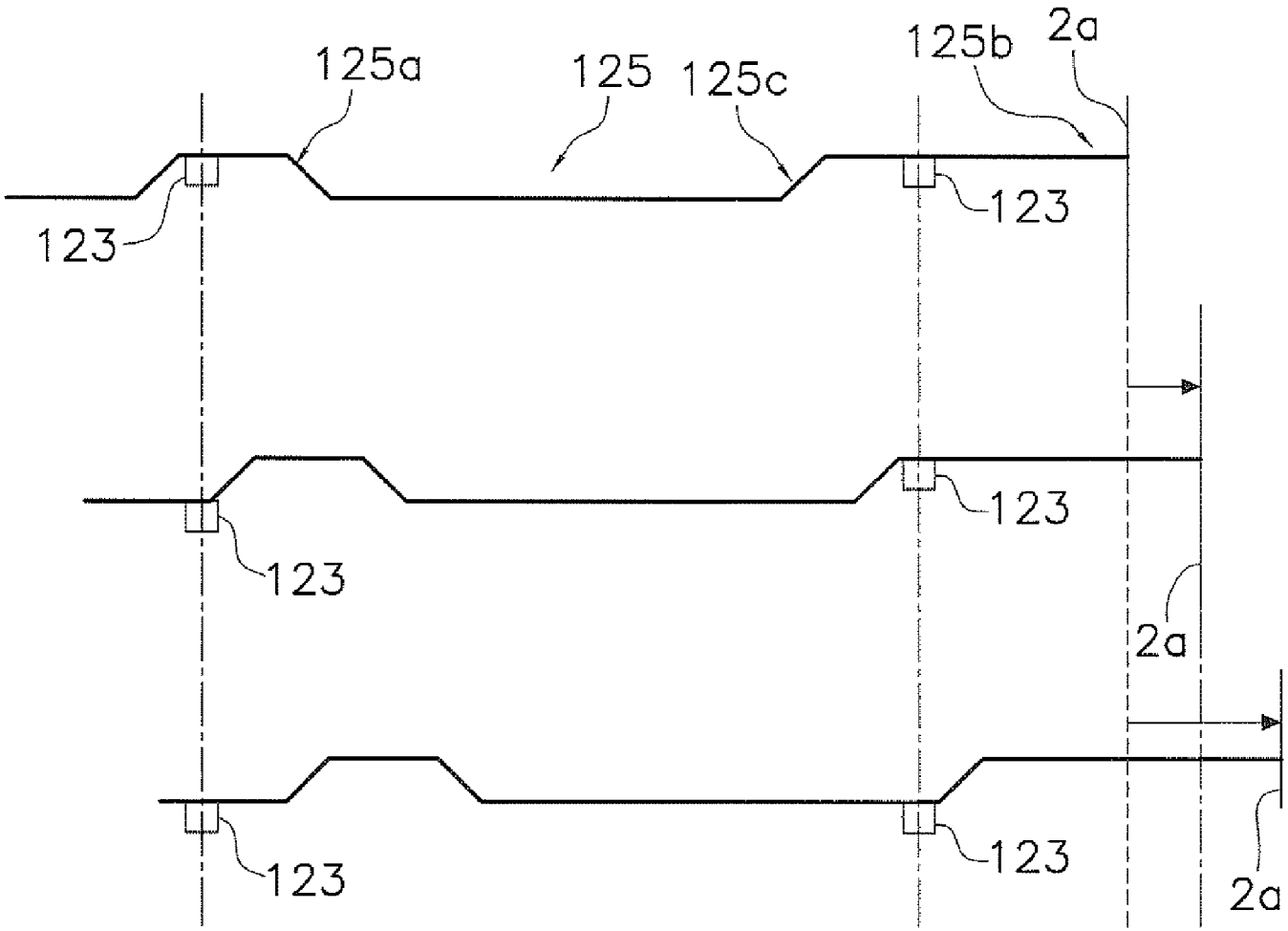
FIG. 12 shows (a) the attachment state of the developing unit to the body of the printer, (b) the semi-attached state of the developing unit to the body of the printer, and (c) the detachment state of the developing unit from the body of the printer, all of which show the movement of the arm member in association with movement of the shaft member in a modification of the second embodiment of the present invention.

For example, in the detachment operation of the developing unit 101 from the printer body in this modification, the shaft member 125 moves to the rear side relative to the casing 121 from the attachment state shown in diagram (a) of FIG. 12. Thus, the shaft member 125 is in a state shown in diagram (b) of FIG. 12. The arm member 123 on the front side is first pushed down by the bent portion 125*a*. Accordingly, the front side end portion of the first developing roller 15 will be in a retracted position from the photosensitive drum 3. Next, the shaft member 125 further moves to the rear side. Thus, the arm member 123 on the rear side is pushed down by the bent portion 125*c* as shown in diagram (c) of FIG. 12. Accordingly, the rear side end portion of the first developing roller 15 will also be in a retracted position from the photosensitive drum 3.

According to the developing unit 101 in accordance with the modification of the second embodiment, two arm members 123 are pushed down in different timings, and the first developing roller 15 is arranged in a proximal position to the photosensitive drum 3 in two steps. Therefore, it is possible to reduce force for operating the shaft member 125, as with the first example of the above described first embodiment.

Third Embodiment

Here, a third embodiment of the present invention will be explained in detail by focusing on differences from the first and second embodiments.

Figure 13:
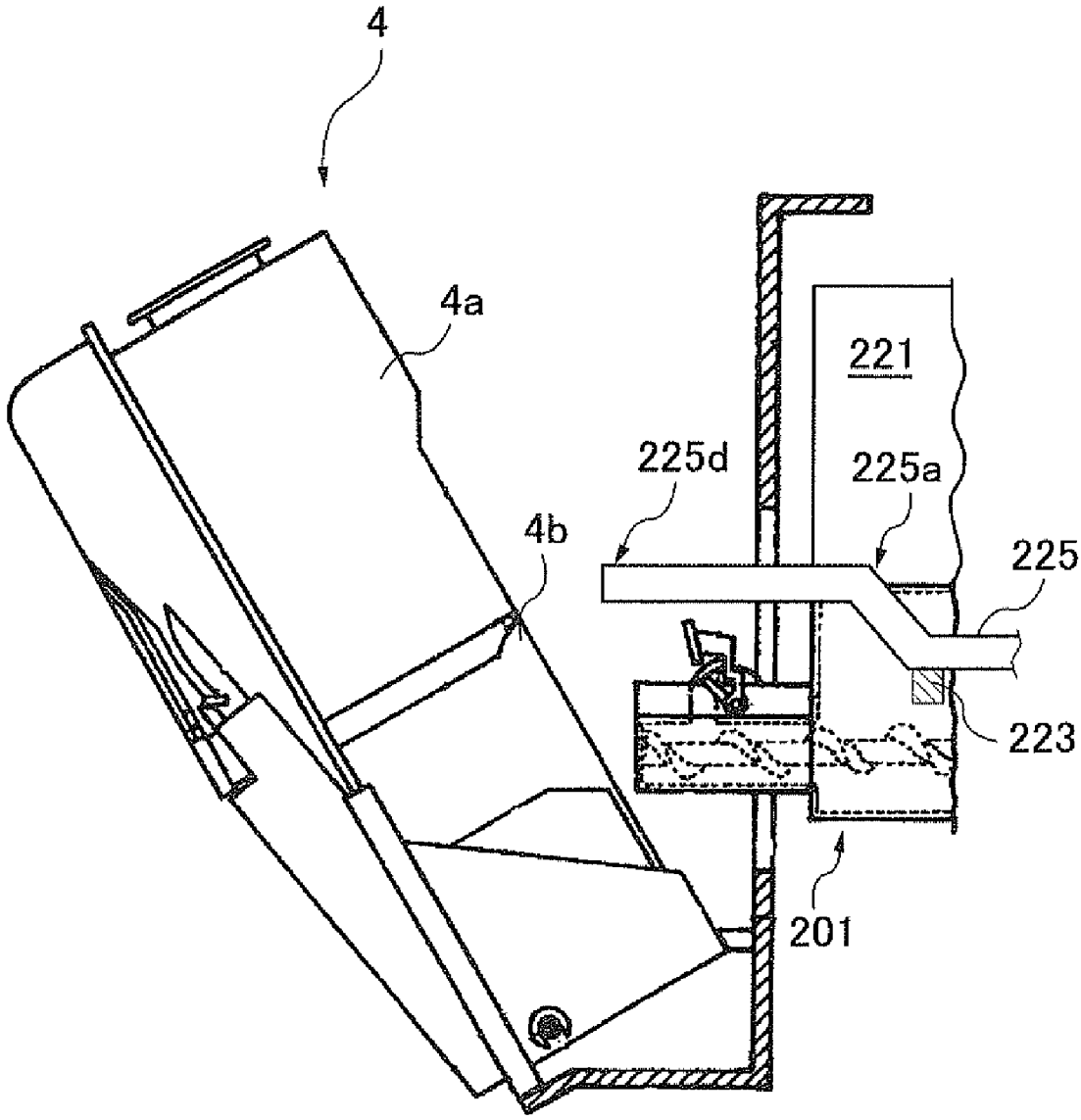
FIG. 13 shows the relevant portions of a longitudinal cross-section of a developing unit to which a third embodiment of the present invention is applied, in which a semi-attached state of the developing unit to the body of the printer is shown.
Figure 14:
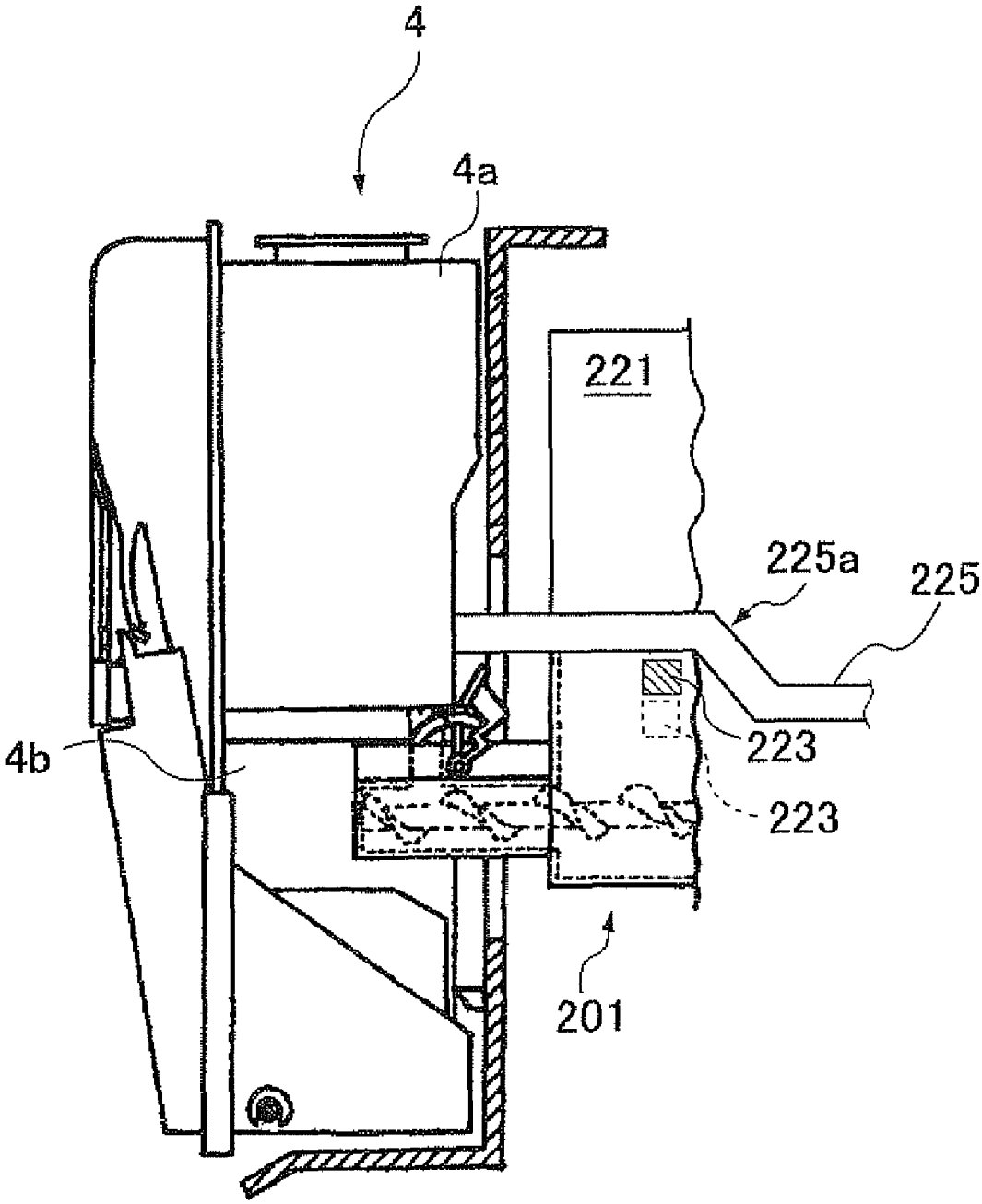
FIG. 14 shows the relevant portions of a longitudinal cross-section of a developing unit in accordance with the third embodiment of the present invention, in which the attachment state of the developing unit to the body of the printer is shown.

FIG. 13 shows the semi-attached state of a developing unit 201 to the printer body. Here, the third embodiment of the present invention is applied to the developing unit 201. FIG. 14 shows the attachment state of the developing unit 201 to the printer body.

Note that the printer body in the third embodiment is configured to be approximately the same as that in the above described first and second embodiments. However, a relief hole 2*b* for incorporating the rear side end portion of a shaft member 225 of the developing unit 201 further to the rear side is formed in the contact portion 2*a* of the unit mounting portion 2. Because of this, the shaft member 225 is configured not to move relative to the casing 221, by simply pushing the developing unit 201 into the unit mounting portion 2.

The shaft member 225 of the developing unit 201 is not formed in a U-shape, but formed to extend in the axial direction. The shaft member 225 is configured to be incorporated in the relief hole 2*b* of the contact portion 2*a* if the end portion 225*b* (i.e., the second contact portion) on the front side is pushed by the toner storage unit 4. In addition, two bent portions 225*a* and 225*c* of the shaft member 225 are herein formed to move two arm members 223 simultaneously. The contact portion 225*b* of the shaft member 225 in the third embodiment is formed in a linear shape as with the above described second embodiment.

In addition, in an unconstrained state, an urging member is configured to urge the shaft member 225 so that the end portion 225*d* on the front side will protrude to the front side in the axial direction. Furthermore, if the end portion 225*d* on the front side is pushed toward the rear side by the back side of the toner storage unit 4, the urging member is configured to make the shaft member 225 resist the urging force and move to the rear side in the axial direction relative to the casing 221.

Figures 15A, 15B:
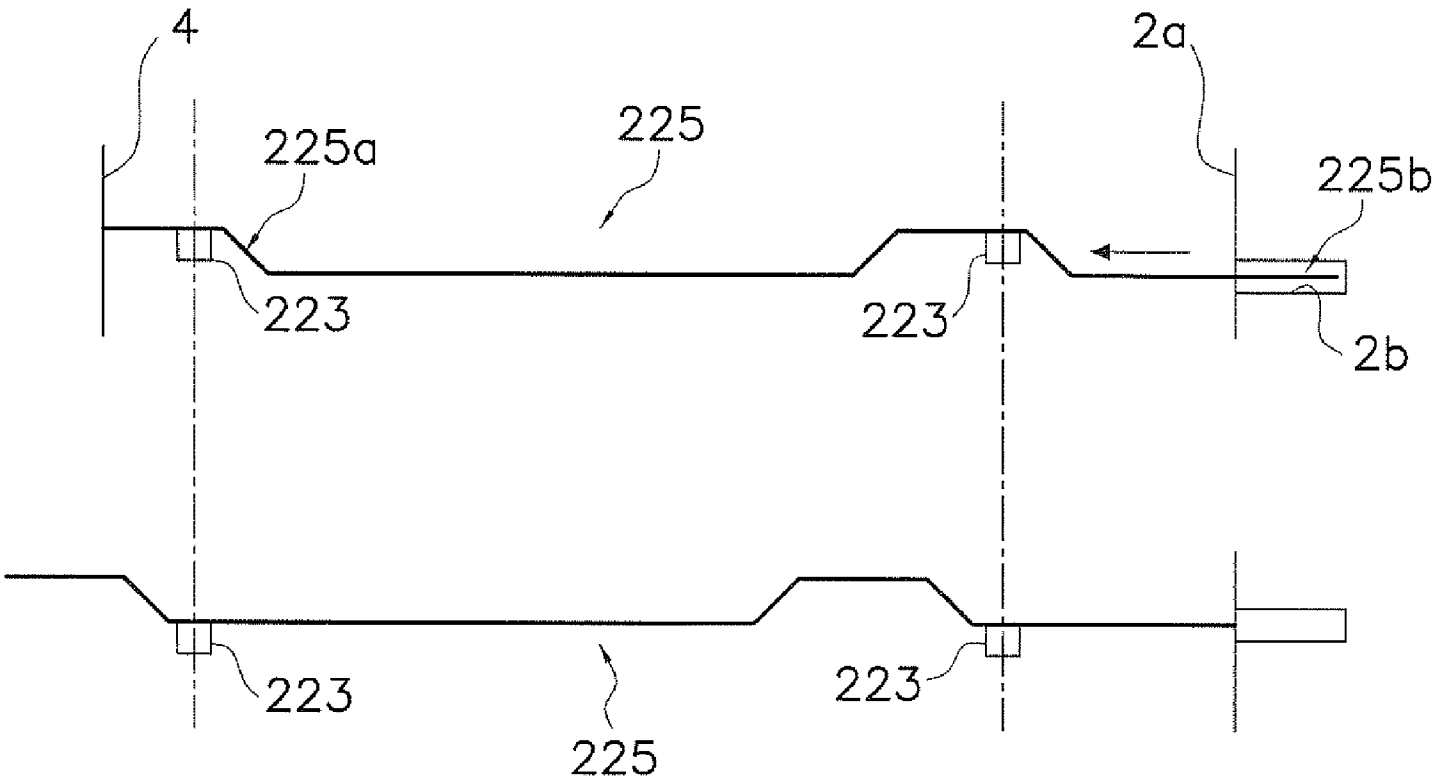
FIG. 15 shows (a) the attachment state of the developing unit to the body of the printer, and (b) the detachment state of the developing unit from the body of the printer, both of which show movement of the arm member in association with movement of the shaft member in the third embodiment of the present invention.

When attaching the developing unit 201 to the printer body, the toner storage unit 4 is swung open to the front side, and then the toner cartridge 4*a* is detached from the toner storage unit 4. In this state, the developing unit 201 is pushed to the rear side of the unit mounting portion 2 of the printer body in the axial direction. Next, the toner cartridge 4*a* is attached to the toner storage unit 4*b*, then the toner storage unit 4 is pulled back up, and the unit mounting portion 2 is closed. At this time, the end portion 225*d* on the front side of the shaft member 225 is pushed by the back side of the toner storage unit 4, and as shown in diagram (a) of FIG. 15, the end portion on the rear side of the shaft member 225 is incorporated in the relief hole 2*b* of the contact portion 2*a*. Note that as shown in FIG. 14, the tip of the arm member 223 on the front side moves to an upper position shown with a solid line from a lower position shown with a dotted line.

On the other hand, when detaching the developing unit 201 from the printer body, the developing unit 4 is first swung open to the front side. At this time, as shown in diagram (b) of FIG. 15, the urging member applies an urging force to the shaft member 225, and the shaft member 225 moves to the front side relative to the casing 221. Next, the developing unit 201 is pulled to the front side, and thus it is detached from the printer body.

Note that as a modification of the third embodiment of the present invention, two bent portions 225*a* and 225*c* of the shaft member 225 may be configured to move two arm members 223 at different timings.

Modifications

The roller contacting/retracting mechanism is not limited to the above described mechanism and may be any type of mechanism that is configured to move the first developing roller to a proximal position to or a retracted position from the photosensitive drum using the other members and the other mechanism. In addition, the arm member and the bearing member in the above described embodiment may be integrally formed with each other.

The developing unit in accordance with the present invention is not limited to a hybrid developing unit, and may be applied to a developing unit including only one developing roller.

The developing unit in accordance with the present invention is not limited to a tandem color printer, and may be applied to a monochrome printer or a one-drum color printer.

The image forming device that comprises the developing device in accordance with the present invention is not limited to a printer, and may be an electrophotographic image forming device such as a multifunction device having other functions such as a copy function and a facsimile function.

The opening/closing unit is not limited to a member having a portion that is mounted to a mounting portion so as to freely open or close, and may be configured to be detachably mounted to a mounting portion.

GENERAL INTERPRETATION

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A developing unit configured to supply toner to a photosensitive drum in an image forming device and is detachably mounted to a body of the image forming device, the developing unit comprising:

a first developing roller that can be arranged in a position proximate to and parallel with the photosensitive drum in the interior of the image forming device body, and arranged in a position retracted from the photosensitive drum;

a second developing roller that is arranged in a position proximate to the first developing roller and configured to supply toner to the first developing roller; and a roller contacting/retracting mechanism configured to move the first developing roller to a position proximate to the photosensitive drum in association with an operation that attaches the developing unit to the image forming device body, and move the first developing roller to a retracted position from the photosensitive drum in association with an operation that detaches the developing unit from the image forming device body, wherein the body of the image forming device comprises a mounting portion that is formed adjacent to the photosensitive drum to extend in the axial direction of the photosensitive drum, the mounting portion having a contact portion that is formed on the rear end in the axial direction, and the roller contacting/retracting mechanism including at least one arm member mounted thereon so as to rotate together with the second developing roller, a shaft member that is configured to extend and be movable in the axial direction, the shaft member comprising a first contact portion that can contact a contact portion of the image forming device body on a rear side end portion thereof in the axial direction, and configured to rotate the at least one arm member together with the second developing roller when moving in the axial direction, and at least one bearing member configured to support the rotation shafts of the first and second developing rollers.

2. The developing unit according to claim 1, wherein the roller contacting/retracting mechanism further comprises an urging member configured to urge the shaft member toward the rear side in the axial direction so that the first contact portion thereof protrudes on the rear side in the axial direction when in an unconstrained state.

3. The developing unit according to claim 1, wherein the at least one arm member comprises two arm members arranged on the front end portion and the rear end portion of the second developing roller in the axial direction, the at least one bearing member comprises two bearing members arranged on the front end portion and the rear end portion of the second developing roller in the axial direction, and the shaft member rotates the two arm members together with the second developing roller when moving in the axial direction.

4. The developing unit according to claim 1, wherein the at least one arm member comprises two arm members arranged on the front end portion and the rear end portion of the second developing roller in the axial direction, the at least one bearing member comprises two bearing members arranged on the front end portion and the rear end portion of the second developing roller in the axial direction, and the shaft member rotates together with the second developing roller at a timing that differs for the two arm members when moving in the axial direction.

5. A developing unit configured to supply toner to a photosensitive drum in an image forming device and is detachably mounted to the body of the image forming device, the developing unit comprising:

a first developing roller that can be arranged in a position proximate to and parallel with the photosensitive drum in the interior of the image forming device body, and arranged in a position retracted from the photosensitive drum;

a roller contacting/retracting mechanism configured to move the first developing roller to a position proximate to the photosensitive drum in association with an operation that attaches the developing unit to the image forming device body, and move the first developing roller to a retracted position from the photosensitive drum in association with an operation that detaches the developing unit from the image forming device body; and a second developing roller that is arranged in a position proximate to the first developing roller and configured to supply toner to the first developing roller, wherein the body of the image forming device comprises a mounting portion that is formed adjacent to the photosensitive drum to extend in axial direction, and an opening/closing unit that is arranged on the front side of the mounting portion in the axial direction and configured to open and close the mounting portion, and the roller contacting/retracting mechanism including at least one arm member mounted thereon so as to be rotatable with the second developing roller, a shaft member that extends in the axial direction and is configured to be movable in the axial direction, the shaft member comprising a second contact portion that can contact the opening/closing unit of the image forming device body on a front side end portion thereof in the axial direction, the shaft member configured to rotate the at least one arm member together with the second developing roller when moving in the axial direction, and at least one bearing member configured to support the rotation shafts of the first and second developing rollers.

6. The developing unit according to claim 5, wherein the roller contacting/retracting mechanism further comprises an urging member configured to urge the shaft member toward the front side in the axial direction so that the second contact portion of the shaft member protrudes on the front side in the axial direction when in an unconstrained state.

7. The developing unit according to claim 5, wherein the at least one arm member comprises two arm members arranged on the front end portion and the rear end portion of the second developing roller in the axial direction, the at least one bearing member comprises two bearing members arranged on the front end portion and the rear end portion of the second developing roller in the axial direction, and the shaft member rotates the two arm members together with the second developing roller when moving in the axial direction.

8. The developing unit according to claim 5, wherein the at least one arm member comprises two arm members arranged on the front end portion and the rear end portion of the second developing roller in the axial direction, the at least one bearing member comprises two bearing members arranged on the front end portion and the rear end portion of the second developing roller in the axial direction, and the shaft member rotates together with the second developing roller at a timing that differs for the two arm members when moving in the axial direction.

9. The developing unit according to claim 5, further comprising a casing in which the first and second developing rollers are arranged therein and developer to be supplied to the photosensitive drum is stored; and wherein the opening/closing unit comprises a developer storage portion configured to store developer and be in communication with the casing when the developing unit is attached to the body of the image forming device.

10. A developing unit configured to supply toner to a photosensitive drum in an image forming device, the developing unit detachably mounted to a body of an image forming device that comprises a mounting portion that is formed adjacent to the photosensitive drum and extends in the axial direction of the photosensitive drum, and a contact portion that is formed on the rear side thereof in the axial direction, the developing unit comprising:

a first developing roller that can be disposed in a position proximate to and parallel with the photosensitive drum in the interior of the image forming device body, and can be moved to a position retracted from the photosensitive drum;

a second developing roller that is arranged in a position proximate to the first developing roller, and configured to supply toner to the first developing roller; and a roller contacting/retracting mechanism configured to move the first developing roller to the position proximate to the photosensitive drum when attaching the developing unit to the body of the image forming device, and move the first developing roller to the position retracted from the photosensitive drum when detaching the developing unit from the body of the image forming device, the roller contacting/retracting mechanism comprising:

at least one arm member mounted thereon so as to rotate together with the second developing roller;

a shaft member that extends in the axial direction and is movable in the axial direction, the shaft member comprising a contact portion that can contact a contact portion of the image forming device body on the rear end portion thereof in the axial direction, and configured to rotate the at least one arm member together with the second developing roller when moving in the axial direction;

at least one bearing member configured to support the rotation shafts of the first and second developing rollers; and an urging member configured to urge the shaft member toward the rear side in the axial direction so that the contact portion of the shaft member will protrude on the rear side in the axial direction when in an unconstrained state.

11. An image forming device comprising:

an image forming device body in which at least one photosensitive drum is arranged therein; and at least one developing unit configured to supply toner to the photosensitive drum, the at least one developing unit detachably mounted to the image forming device body and including a first developing roller that can be moved to a position parallel to and proximate to the at least one photosensitive drum, and a position retracted from the at least one photosensitive drum, and a roller contacting/retracting mechanism configured to move the first developing roller to the position proximate to the at least one photosensitive drum when the at least one developing unit is attached to the body of the image forming device, and move the first developing roller to the position retracted from the at least one photosensitive drum when the at least one developing unit is detached from the image forming device body, wherein the body of the image forming device has a mounting portion that is formed adjacent to the photosensitive drum to extend in the axial direction of the photosensitive drum, the mounting portion having a contact portion that is formed on the rear end in the axial direction, and the roller contacting/retracting mechanism including at least one arm member mounted thereon so as to rotate together with the second developing roller, a shaft member that is configured to extend and be movable in the axial direction, the shaft member comprising a first contact portion that can contact a contact portion of the image forming device body on a rear side end portion thereof in the axial direction, and configured to rotate the at least one arm member together with the second developing roller when moving in the axial direction, and at least one bearing member configured to support the rotation shafts of the first and second developing rollers.

12. The image forming device according to claim 11, wherein the at least one photosensitive drum comprises four photosensitive drums; and the at least one developing unit comprises four developing units arranged to correspond to the four photosensitive drums, respectively.

13. An image forming device comprising:

an image forming device body in which at least one photosensitive drum is arranged therein; and at least one developing unit configured to supply toner to the photosensitive drum, the at least one developing unit detachably mounted to the image forming device body and including a first developing roller that can be moved to a position parallel to and proximate to the at least one photosensitive drum, and a position retracted from the at least one photosensitive drum, and a roller contacting/retracting mechanism configured to move the first developing roller to the position proximate to the at least one photosensitive drum when the at least one developing unit is attached to the body of the image forming device, and move the first developing roller to the position retracted from the at least one photosensitive drum when the at least one developing unit is detached from the image forming device body, wherein the body of the image forming device comprises a mounting portion that is formed adjacent to the photosensitive drum to extend in axial direction, and an opening/closing unit that is arranged on the front side of the mounting portion in the axial direction and configured to open and close the mounting portion, and the roller contacting/retracting mechanism including at least one arm member mounted thereon so as to be rotatable with the second developing roller, a shaft member that extends in the axial direction and is configured to be movable in the axial direction, the shaft member comprising a second contact portion that can contact the opening/closing unit of the image forming device body on a front side end portion thereof in the axial direction, the shaft member configured to rotate the at least one arm member together with the second developing roller when moving in the axial direction, and at least one bearing member configured to support the rotation shafts of the first and second developing rollers.

14. The image forming device according to claim 13, wherein the at least one photosensitive drum comprises four photosensitive drums; and the at least one developing unit comprises four developing units arranged to correspond to the four photosensitive drums, respectively.

* * * * *